United States Patent [19]

Yu

[11] 3,973,383

[45] Aug. 10, 1976

[54] FRICTION FALSETWIST DEVICE

[75] Inventor: Jing-Peir Yu, Pensacola, Fla.

[73] Assignee: Monsanto Company, St. Louis, Mo.

[22] Filed: Dec. 26, 1974

[21] Appl. No.: 536,685

[52] U.S. Cl. ..... 57/77.4

[51] Int. Cl.[2] ..... D02G 1/04

[58] Field of Search ..... 57/77.3–77.45

[56] References Cited

UNITED STATES PATENTS

| | | | |
|---|---|---|---|
| 3,287,890 | 11/1966 | McIntosh et al. | 57/77.4 |
| 3,762,149 | 10/1973 | Raschle | 57/77.4 |
| 3,813,868 | 6/1974 | Lorenz | 57/77.4 |
| 3,820,317 | 6/1974 | Raschle | 57/77.4 |
| 3,872,661 | 3/1975 | Eaves | 57/77.4 |
| 3,885,378 | 5/1975 | Schuster | 57/77.4 X |
| 3,901,011 | 8/1975 | Schuster | 57/77.4 |

FOREIGN PATENTS OR APPLICATIONS

| | | | |
|---|---|---|---|
| 854,781 | 11/1960 | United Kingdom | 57/77.4 |

*Primary Examiner*—Donald E. Watkins
*Attorney, Agent, or Firm*—Kelly O. Corley

[57] ABSTRACT

In a false twist friction aggregate, the friction discs are of differing diameters, permitting more flexibility in selecting twist and tension levels.

6 Claims, 4 Drawing Figures

FRICTION FALSETWIST DEVICE

The invention relates to apparatus for producing a false twist in a moving strand or yarn. More particularly, the invention relates to such apparatus wherein the yarn tensions and the twist levels can be preselected with a useful degree of independence from one another.

Various references disclose the type of false twist apparatus wherein at least three substantially parallel shafts rotating in the same direction are grouped about the yarn path, each shaft supporting and driving at least one and preferably a plurality of friction discs which are interleaved between the discs of the other shafts. The disc diameters are large enough with respect to the spacing between the shafts that a yarn passing through the device from inlet to outlet will follow a distinctly tortuous path as it contacts and is deflected by the successive discs. Such false twisting devices are disclosed, for example, in FIGS. 2–8 of U.S. Pat. No. 3,813,868 to Lorenz, the disclosure of which is incorporated herein by reference, and are referred to herein as "friction aggregates". Other patents disclosing friction aggregates include U.S. Pat. Nos. 2,939,269; 3,827,228; and 2,923,121, although the friction disc diameters in this latter patent are not sufficiently large with respect to the spacing between its shafts to deflect the yarn into an adequately tortuous path for good twist development. The discs are preferably interleaved in a sequence such that a yarn passing through the friction aggregate from inlet to outlet will sequentially contact the successive discs at points lying on a helix of the same hand as the direction of rotation of the discs, as disclosed in U.S. Pat. Nos. 3,813,868 and 3,827,228.

Known friction aggregates, such as those disclosed in the above-noted patents (with the exception of the Lorenz patent), do not permit independent selection of the twist level and yarn tensions. When the rotational speed of the discs is selected to provide a desired high level of false twist, the tension in the yarn entering the inlet end of the friction aggregate is frequently undesirably high, while the tension in the yarn leaving the outlet end is frequently undesirably low. Either or both of these tension conditions can cause difficulties in the process or defects in the product produced.

The Lorenz patent discloses that the spacing between the shafts can be adjusted, thus exerting some control over tensions and twist levels. Such adjustment does not, per se, permit a satisfactory degree of independent selection of tensions and twist level. The Lorenz patent does disclose an approach to solving the problem of independent selection, by driving one or more supplementary friction discs at different angular velocities than those of the remainder of the discs. This approach has the disadvantage of requiring a more complex and expensive mechanism than the more simple friction aggregates.

According to the invention, the above difficulties and disadvantages are overcome or substantially reduced by providing friction discs of differing diameters rotating at the same angular velocity, as more fully disclosed below.

A primary object of the invention is to provide a novel friction aggregate wherein the tensions and twist levels can be independently controlled.

A further object is to provide a friction aggregate of the above character wherein twist levels are increased.

A further object is to provide a friction aggregate of the above character wherein tensions before, in, and after the aggregate can be selected over a wide range.

Other objects will in part appear hereinafter and will in part be obvious from the following disclosure taken in connection with the accompanying drawing, wherein.

Figure 1:
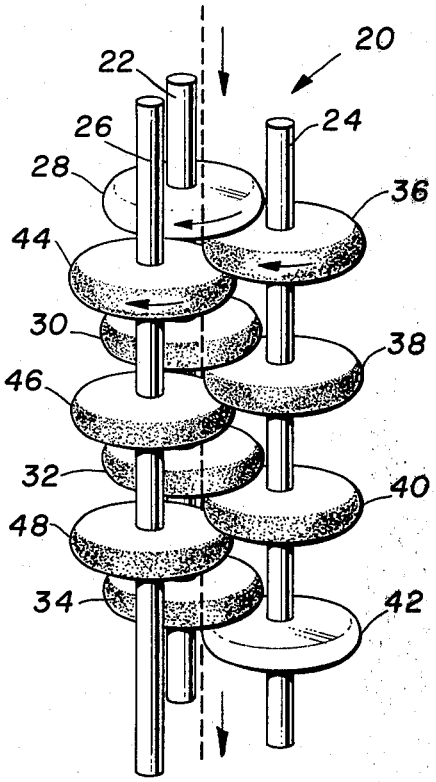
FIG. 1 is a schematic perspective view of a preferred exemplary friction aggregate.

As illustrated in FIG. 1, aggregate 20 includes three substantially parallel shafts 22, 24, and 26 supported and driven by non-illustrated means for rotation in the same direction. While four or more shafts could be provided, as disclosed in the Lorenz patent, ordinarily little is gained by using more than three shafts. In the illustrated embodiment, shaft 22 supports and drives inlet end guide disc 28 and friction discs 30, 32, and 34. In like manner, shaft 24 supports and drives friction discs 36, 38, 40 and outlet end guide disc 42, while shaft 26 supports and drives friction discs 44, 46 and 48. Guide discs 28 and 42 are preferably formed from a wear-resistant material such as a ceramic or metal, and are believed to impart relatively little torque to the yarn in this aggregate design. Discs 28 and 42 thus function essentially as guides for controlling the angles by which the yarn is introduced to the inlet friction disc 36 and withdrawn from the outlet friction disc 34, respectively. The friction discs preferably have rims formed from a material having a higher coefficient of friction, such as polyurethane.

According to the invention, at least one (and preferably a plurality) of the discs has a smaller diameter than at least one of the other discs. All other things being equal, replacement of a disc of given diameter with one of smaller diameter will result in lower yarn tensions upstream and higher tensions downstream of the disc. If the smaller disc or discs are near the inlet end of the friction aggregate, the higher downstream tension can result in significantly higher twist levels produced by the friction aggregate. Particularly when texturing yarns of above 100 denier, it is frequently advantageous to provide discs of a plurality of different diameters smaller than that of other discs. Especially preferred is a construction wherein the disc diameters increase in more than one step from a smallest value near the inlet end to the maximum disc diameter at a subsequent disc nearer the outlet end.

In one preferred embodiment, the distance between shafts 22 and 24 is 37 millimeters, and the distances between shafts 22 and 26 and between shafts 24 and 26 are each 38 millimeters. Disc 28 has a diameter of 45 millimeters, discs 36 and 44 have diameters of 47 millimeters, disc 30 has a diameter of 48 millimeters, and all the subsequent discs have diameters of 50 millimeters. Discs 28 and 42 are formed from steel, while each of the remaining discs is formed from an elastomeric polyurethane. The discs are 6.5 millimeters thick, and the rims are rounded or crowned with a radius of curvature of 3.25 millimeters. The axial spacing between adjacent interleaved discs, i.e., between discs 28 and 36, between discs 36 and 44, etc., is 0.5 millimeters.

Figure 2:
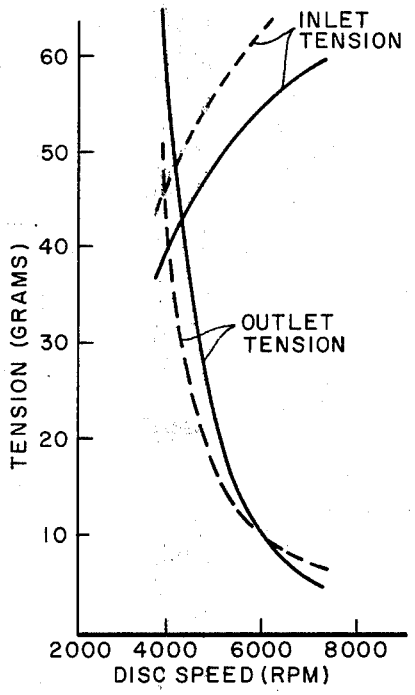
FIG. 2 is a graph showing tension effects produced by the invention.
Figure 3:
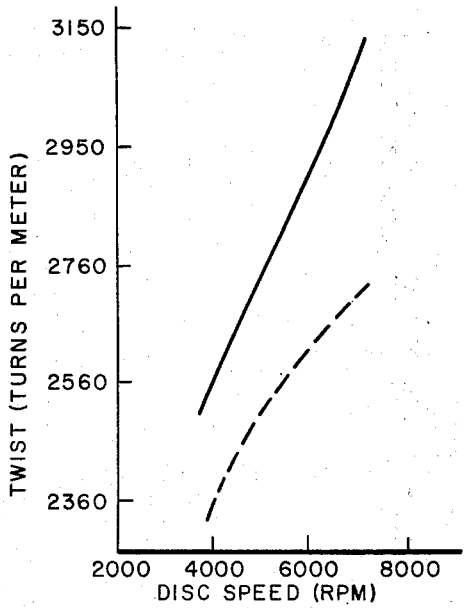
FIG. 3 is a graph showing twist effects produced by the invention.

Typical twist levels and tensions encountered while texturing a 150 denier, 34 filament polyethylene terephthalate yarn at 400 yards (366 meters) per minute with the above preferred friction aggregate are shown in the solid curves in FIGS. 2 and 3. Results from a control friction aggregate wherein all discs have diameters of 50 millimeters, the control friction aggregate being otherwise identical to the preferred friction aggregate, are shown in dotted lines in FIGS. 2 and 3. At the same disc angular velocity, the preferred aggregate produces higher twist levels at the inlet of the friction aggregate, lower inlet tension, and generally higher outlet tension, as compared to the control aggregate.

Not only could comparable twist levels be produced at lower RPM using the preferred aggregate, but the quality of the textured yarn is superior to that produced with the control aggregate. Yarn which has been textured by the false-twist heat-set method frequently has local defects referred to as "tight spots". These are local sections of yarn containing twist, which prevents the desired bulking or blooming of the yarn. When the yarn is converted into fabric, the tight spots cause the appearance of voids or pin-holes in the fabric. The problem of tight spots is more severe with friction aggregates than with the conventional spindlettes.

The above polyethylene terephthalate yarn false twisted and heat set with 2560 turns per meter false twist by the control aggregate (approximately 5500 RPM disc speed) contains numerous tight spots, and is not of commercial quality, while yarn produced at the same twist level by the preferred aggregate (approximately 4000 RPM disc speed) contains very few tight spots, and is considered to be of excellent commercial quality.

Figure 4:
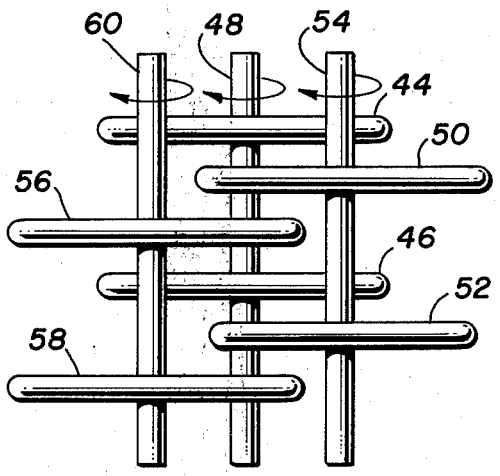
FIG. 4 is a front elevation view of an alternative exemplary friction aggregate according to the invention.

FIG. 4 illustrates an alternative form of friction aggregate according to the invention, and is particularly adapted for texturing light denier yarns. In this embodiment, discs 44 and 46 are mounted on shaft 48, discs 50 and 52 are mounted on shaft 54, and discs 56 and 58 are mounted on shaft 60. Discs 44 and 58 are formed from steel, while the intermediate discs are formed from an elastomeric polyurethane. All the discs have thicknesses of 4 millimeters, and the spacing between adjacent discs in an axial direction is 0.5 millimeter. The final friction disc 52 has a diameter of 45 millimeters while all other discs have diameters of 50 millimeters. The disc rims or edges are rounded or crowned with a radius of curvature of 2 millimeters.

Nylon 66 yarn having 40 denier and 13 filaments is textured by the false-twist heat-set process at a speed of 850 yards (777 meters) per minute on a conventional texturing machine using the FIG. 4 friction aggregate to impart false twist. The discs are rotated at 10,500 RPM. Disc 52 is then replaced with a polyurethane disc having a diameter of 50 millimeters, and the experiment is repeated. As compared to the process using the FIG. 4 friction aggregate, the downstream tension is lower when using the large final friction disc. The resulting yarn has many tight spots and would not be commercially acceptable, while the yarn produced using the small final disc according to FIG. 4 is sufficiently free of tight spots to be fully acceptable for commercial use.

I claim:

1. In a friction aggregate wherein at least three substantially parallel shafts are grouped around a yarn path extending from the inlet end to the outlet end of said aggregate, each said shaft supporting and driving at least one disc interleaved between discs on each of said other shafts, the disc diameters being large enough with respect to the spacing between said shafts that a yarn passing through said aggregate from inlet to outlet will follow a tortuous path as said yarn contacts and is deflected by successive discs, the improvement wherein a first of said discs has a smaller diameter than at least one other of said discs.

2. The aggregate defined in claim 1, wherein said first of said discs is nearer the inlet end of said aggregate than said at least one other of said discs.

3. The aggregate defined in claim 1, wherein said first of said discs is nearer the outlet end of said aggregate than said at least one other of said discs.

4. The aggregate defined in claim 1, wherein a plurality of said discs have smaller diameters than said at least one other of said discs.

5. The aggregate defined in claim 4, wherein said plurality of said discs comprises discs of different diameters.

6. The aggregate defined in claim 1, wherein the diameters of said discs increase in more than one step from a smallest value near the inlet end of said aggregate to a maximum value at a subsequent disc nearer the outlet end of said aggregate.

* * * * *